US008490335B2

(12) United States Patent
LaForest

(10) Patent No.: US 8,490,335 B2
(45) Date of Patent: Jul. 23, 2013

(54) REMOVABLE SEATS SYSTEM

(75) Inventor: Pierre LaForest, Montreal (CA)

(73) Assignee: Gestion Laforest Inc., St-Hubert, Quebec (CA)

( * ) Notice: Subject to any disclaimer, the term of this patent is extended or adjusted under 35 U.S.C. 154(b) by 121 days.

(21) Appl. No.: 13/128,792

(22) PCT Filed: Nov. 20, 2009

(86) PCT No.: PCT/CA2009/001681

§ 371 (c)(1),
(2), (4) Date: May 11, 2011

(87) PCT Pub. No.: WO2010/057309

PCT Pub. Date: May 27, 2010

(65) Prior Publication Data

US 2011/0215621 A1 Sep. 8, 2011

Related U.S. Application Data

(60) Provisional application No. 61/199,969, filed on Nov. 21, 2008.

(51) Int. Cl.
*E04H 3/12* (2006.01)

(52) U.S. Cl.
USPC ..... 52/8

(58) Field of Classification Search
USPC ..... 52/6, 7, 8, 9, 10
See application file for complete search history.

(56) References Cited

U.S. PATENT DOCUMENTS

| | | | | | |
|---|---|---|---|---|---|
| 328,883 | A | * | 10/1885 | Felton | 297/15 |
| 1,517,774 | A | | 12/1924 | Duprey | |
| 1,801,681 | A | | 4/1931 | Mowery | |
| 2,817,389 | A | | 12/1957 | Richards | |
| 2,987,111 | A | * | 6/1961 | Walworth | 52/9 |
| 3,025,106 | A | * | 3/1962 | Evans et al. | 297/248 |
| 3,533,585 | A | | 10/1970 | Hollermann et al. | |
| 3,918,225 | A | * | 11/1975 | Fisher et al. | 52/125.1 |
| 4,379,378 | A | * | 4/1983 | McMahan | 52/9 |
| 4,934,113 | A | * | 6/1990 | Hall et al. | 52/7 |
| 5,121,891 | A | | 6/1992 | Goldsmith | |
| 5,228,246 | A | * | 7/1993 | Suzuki et al. | 52/9 |
| 5,271,190 | A | | 12/1993 | Sugiyama | |
| 5,277,001 | A | * | 1/1994 | Bryant | 52/10 |
| 5,328,238 | A | * | 7/1994 | Yamazaki | 297/332 |
| 5,349,789 | A | * | 9/1994 | Andert et al. | 52/7 |

(Continued)

FOREIGN PATENT DOCUMENTS

| | | |
|---|---|---|
| DE | 29922288 U1 | 3/2000 |
| FR | 2576952 | 8/1986 |

(Continued)

*Primary Examiner* — Mark Wendell
*Assistant Examiner* — Keith Minter
(74) *Attorney, Agent, or Firm* — Fraser Clemens Martin & Miller LLC; J. Douglas Miller

(57) ABSTRACT

The removable seats system has a first vertically movable platform defining opposite upper and lower sides, a seat member comprising at least one seat and first and second complementary male-female engagement members respectively provided on the first platform and on the seat member. The seat member may be removably installed in an operative position on the upper side of the first platform through a releasable engagement of the first and second male-female engagement members with one another.

22 Claims, 10 Drawing Sheets

U.S. PATENT DOCUMENTS 5,365,704 A * 11/1994 Ray ..... 52/64
5,385,323 A * 1/1995 Garelick ..... 248/161
5,425,214 A * 6/1995 Truelove et al. ..... 52/762
5,517,789 A 5/1996 Sugiyama
5,685,608 A * 11/1997 Yamazaki ..... 297/335
5,819,475 A * 10/1998 Momose ..... 52/10
5,826,850 A 10/1998 Goldsmith
5,829,201 A * 11/1998 Schelter et al. ..... 52/9
5,996,286 A * 12/1999 West ..... 52/8
6,055,780 A * 5/2000 Yamazaki ..... 52/9
6,244,657 B1 * 6/2001 Momose ..... 297/217.7
6,484,450 B1 * 11/2002 Suprina et al. ..... 52/8
6,920,658 B1 * 7/2005 Miraglia ..... 14/69.5
7,172,245 B2 2/2007 Bouchard et al.
7,213,796 B2 * 5/2007 Laforest ..... 254/1
7,303,235 B1 * 12/2007 Fongers ..... 297/337
7,617,635 B2 * 11/2009 Jacobs et al. ..... 52/8
2004/0123529 A1 * 7/2004 Wiese et al. ..... 52/6
2011/0215621 A1 * 9/2011 LaForest ..... 297/217.7

FOREIGN PATENT DOCUMENTS

FR 2664637 1/1992
FR 2687713 8/1993
FR 2746435 9/1997

* cited by examiner

REMOVABLE SEATS SYSTEM

CROSS-REFERENCE DATA

The present patent application claims priority under the Paris Convention of U.S. provisional patent application No. 61/199,969 filed on Nov. 21, 2008.

FIELD OF THE INVENTION

The present invention relates to a removable seats system, and more particularly to a removable seats system for use in a multipurpose room.

BACKGROUND OF THE INVENTION

It is known to provide removable seats in multipurpose rooms. For example, some rooms are used both in a theatre room configuration wherein rows of seats that are releasably fixed to the ground are provided, and in a free floor room configuration wherein the seats are removed to allow the floor to be used differently for trade shows, conferences, dinners, stage extensions (see FIG. 2 of the annexed drawings for example) or the like. To accommodate such a hybrid room, a removable seats system can be incorporated into the room to allow the seats to be removed and installed according to the daily purpose of the room.

In theatre room configuration, fixed seats are preferable over loose seats that may move over ground for numerous reasons, including the fact that loose seats can be noisy during theatre room shows. Consequently, it is desirable for multipurpose rooms to have their removable seats be releasably fixed to the ground when in their theatre room configuration. Furthermore, it is preferable that the fixed seats be easy to stow when they are removed, for example in the multipurpose room itself. It has been found that stowing the seats underneath floor platforms is both easy and practical, since the seats remain readily accessible for installation while being concealed when not in use.

It is also desirable for the multipurpose rooms to have a segmented floor comprising a number of vertically movable platforms to configure the floor either in a gradually ascendant configuration away from the theatre scene when in theatre room configuration, or in a flat floor configuration when in free floor configuration.

One challenge in having movable floor platforms is to have the floor remain very stable when attendees walk on it, both in theatre room configuration and in free floor configuration. Indeed, even very small movements of the floor can be detected by attendees and these can be disturbing. Likewise, the seats must also be very stable when installed in theatre room configuration. Again, very small movements of the seats are disturbing for those seated on them.

Some prior art multipurpose rooms propose removable seats systems wherein seats are stowed underneath the floor platforms when they are not required, while being raised or installed on the floor when the theatre room configuration is required. However, the prior art systems fail to properly address the problem of both the floor platforms and the seats being stable and unmoving while providing a simple and practical removable seats system by which it is easy to install and remove the seats. To address the practicality issue, some prior art systems propose automated systems wherein the seats may be moved from underneath the floor platforms to an operative position above. Notwithstanding very complex, expensive or impractical prior art solutions, one particular problem with some prior art systems is that the floor platforms are either significantly spaced apart, which yields possible movement of the platforms and/or aesthetically undesirable results and/or gaps that can be accidentally engaged by high heels; or provided with non-trivial openings in the platforms themselves that allow the seats to be raised into their operative position which structurally weakens the platforms. These solutions make for unstable floors even once the seats are entirely installed or removed, which is disturbing for the attendees that walk on them. Most prior systems also provide seats that engage the floor platforms in an unstable manner, which yields seats that are allowed to move and again this is disturbing for the persons sitting on the seats.

SUMMARY OF THE INVENTION

The present invention relates to a removable seats system comprising:

a first vertically movable platform defining opposite upper and lower sides;

a seat member comprising at least one seat; and first and second complementary male-female engagement members respectively provided on said first platform and on said seat member;

wherein said seat member may be removably installed in an operative position on said upper side of said first platform through a releasable engagement of said first and second male-female engagement members with one another.

In one embodiment, said first and second male-female engagement members respectively comprise first and second complementary male-female wedge members, whereby said seat member may be removably installed in said operative position on said upper side of said first platform through the releasable engagement of said first and second male-female wedge members with one another in a wedging relationship.

In one embodiment, one of said first and second male-female wedge members comprises a pin member having a tapering outer wall and the other of said first and second male-female wedge members comprises a socket having a tapering bore for receiving said pin member in releasable wedging relationship.

In one embodiment, said seat member comprises a number of pin members having a tapering outer wall and said platform comprises a number of sockets having a tapering bore, each said socket capable of receiving one of said pin members in releasable wedging relationship.

In one embodiment, each said socket comprises a cap movable between an opened position in which access to said tapering bore is allowed and a closed position in which it covers said tapering bore, whereby one of said pin members may be received in a corresponding said socket when said socket cap is in said opened position.

In one embodiment, the removable seats system further comprises a second platform defining upper and lower sides and which is horizontally adjacent and vertically movable with respect to said first platform, and a seat stowing structure installed on said lower side of said second platform wherein said seat member may be stowed on said stowing structure in a stowed position when it is not in said operative position.

In one embodiment, the removable seats system further comprises a first horizontal seat displacer provided on said second platform and capable of moving said seat member along a horizontal direction, wherein through the combined vertical relative movement of said first and second platforms and horizontal movement of said first horizontal seat displacer, said seat member can be moved between said stowed position and said operative position.

In one embodiment, said first horizontal seat displacer comprises a first rail member on which a first carriage is movable and a first carriage actuator capable of moving said first carriage along said horizontal direction, whereby said seat member resting on said carriage may be moved along said horizontal direction.

In one embodiment, the removable seats system further comprises a second horizontal seat displacer comprising a second rail member on which a second carriage is movable and a second carriage actuator capable of moving said second carriage along said horizontal direction, whereby said seat member resting on said first and second carriage may be moved along said horizontal direction.

In one embodiment, the removable seats system further comprises a releasable locking mechanism for releasably locking said first and second male-female engagement members with one another.

The present invention further relates to a method of removably installing a seat member having at least one seat in an operative position on a first platform having upper and lower sides, comprising the steps of:

providing first and second complementary male-female engagement members respectively on said first platform and on said seat member; and moving said seat member spacedly over and relative to said first platform upper side until said first and second male-female engagement members releasably engage one another, said first platform thereby supporting said seat member through the inter-engagement of said first and second male-female engagement members.

In one embodiment, the step of moving said seat member spacedly over and relative to said first platform upper side until said first and second male-female engagement members releasably engage one another comprises the following steps:

positioning said seat member spacedly over said first platform upper side for said first and second male-female engagement members to become aligned with one another; and lowering said seat member relative to said first platform upper side until said first and second male-female engagement members releasably engage one another, said first platform thereby supporting said seat member through the inter-engagement of said first and second male-female engagement members.

In one embodiment, the step of providing first and second complementary male-female engagement members respectively on said first platform upper side and on said seat member comprises providing complementary first and second male-female wedge members respectively on said first platform and on said seat member whereby in the step of lowering said seat member relative to said first platform upper side until said first and second male-female engagement members releasably engage one another, said first and second male-female wedge members releasably engage one another in wedging relationship.

In one embodiment, the step of providing first and second male-female wedge members respectively on said first platform upper side and on said seat member comprises providing pin members having a tapering outer wall on said seat members and sockets having a tapering bore on said platforms whereby in the step of lowering said seat member relative to said first platform upper side until said first and second male-female wedge members releasably engage one another, said pin members are received in said socket bores in releasable wedging relationship.

In one embodiment, the method further comprises the following steps:

providing caps covering said sockets tapering bores; and before the step of lowering said seat member relative to said first platform upper side until said first and second male-female wedge members releasably engage one another, moving said caps towards an opened position in which access to said tapering bores is allowed.

In one embodiment, the method further comprises the following steps:

providing a second platform having upper and lower sides and which is horizontally adjacent and vertically movable with respect to said first platform, said second platform comprising a seat stowing structure installed on its lower side; and before the step of positioning said seat member spacedly over said first platform upper side for said second male-female engagement members to become aligned with said first male-female engagement members, providing said seat member on said stowing structures in a stowed position.

In one embodiment, the method further comprises the step of providing a horizontal seat displacer on said second platform capable of moving said seat member along a horizontal direction, wherein the step of positioning said seat member spacedly over said first platform upper side for said second male-female engagement members to become aligned with said first male-female engagement members is accomplished by relatively positioning said first and second platforms vertically to have said seat member vertically clear said first platform above said first platform upper side when it is in said stowed position and by thereafter moving said seat member along said horizontal direction by means of said horizontal seat displacer, and wherein the step of lowering said seat member relative to said first platform upper side until said first and second male-female engagement members releasably engage one another is accomplished by vertically moving said first and second platforms with respect to one another.

In one embodiment, said horizontal seat displacer comprises a rail member on which a carriage is movable and a carriage actuator capable of moving said carriage along said horizontal direction, with said seat member resting on said carriage when in said stowed position, the step of moving said seat member along said horizontal direction by means of said horizontal seat displacer comprising moving said carriage along said horizontal direction while said seat member rests on said carriage.

In one embodiment, the step of providing first and second complementary male-female engagement members respectively on said first platform upper side and on said seat member comprises providing complementary first and second male-female wedge members respectively on said first platform and on said seat member whereby the step of lowering said seat member relative to said first platform upper side until said first and second male-female engagement members releasably engage one another is accomplished by vertically moving said first and second platforms with respect to one another until said first and second male-female wedge members releasably engage one another in wedging relationship.

In one embodiment, the method further comprises the following step during or after the step of lowering said seat member relative to said first platform upper side until said first and second male-female engagement members releasably engage one another:

releasably locking said first and second engagement members to one another.

DETAILED DESCRIPTION OF THE EMBODIMENTS

Figure 1:
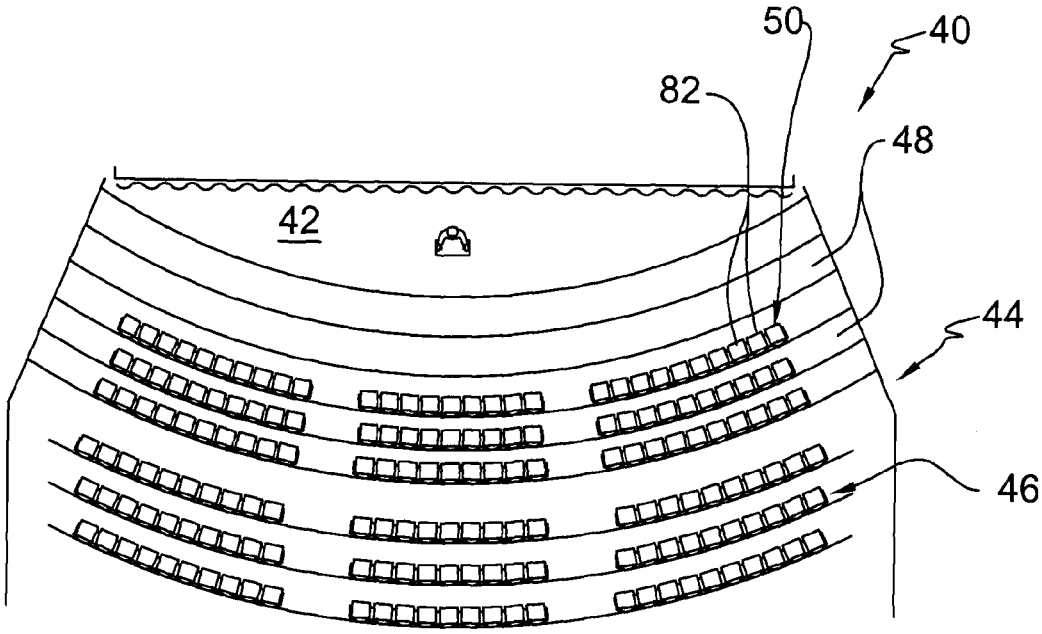
FIG. 1 is a schematic top plan view of a multipurpose room equipped with a removable seats system according to the present invention, showing a speaker using the room and with the room in its theatre room configuration.
Figure 2:
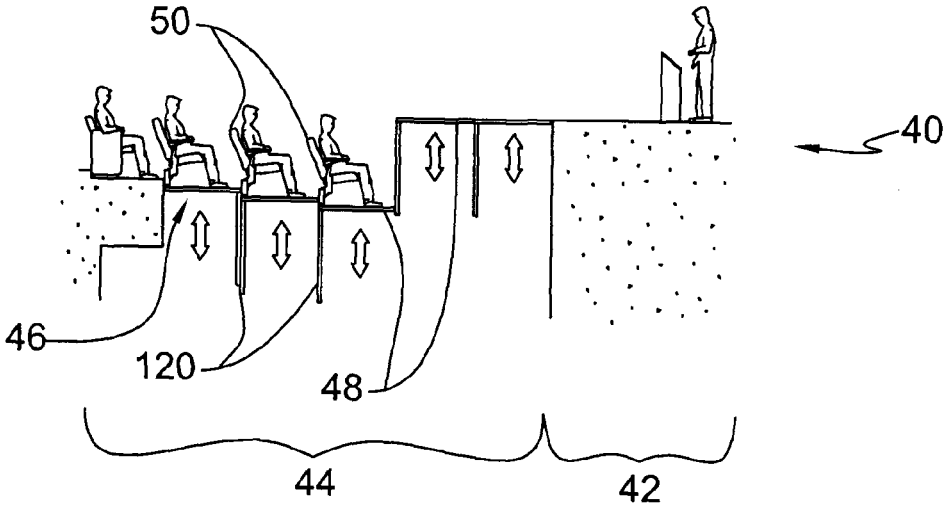
FIG. 2 is a partial schematic side elevation, at an enlarged scale, of the room of FIG. 1, with the platform lifting mechanisms being omitted and showing a few attendees and a speaker using the room.

FIGS. 1 and 2 schematically show a multipurpose room 40 which can be configured either in a theatre room configuration to accommodate a seated attendance (as illustrated in FIGS. 1-2) or alternately in a free floor configuration (FIG. 10) wherein all theatre seats are stowed away to allow the room to be used for dinners, shows or any other desired event wherein the theatre seats are not required.

Room 40 comprises a front stage portion 42 and a main room portion 44 which is provided with a removable seats system 46 according to the present invention. As will be detailed hereinafter, removable seats system 46 comprises a number of vertically movable platforms 48 which collectively form a floor for people in main room portion 44. Platforms 48 can be installed at selected elevations and a number of seat members 50 can be selectively installed on the platforms. If seat members 50 are installed on platforms 48, then room 40 is said to be in its theatre room configuration wherein attendees may be seated on seat members 50. If seat members 50 are removed from the platforms and stowed under platforms 48 as detailed hereinafter, then room 40 is said to be in its free floor configuration and may then be used to receive a standing attendance or to install tables and chairs on the floor formed by the platforms 48, or for any other desired purpose wherein seat members 50 are not required.

Each seat member 50 includes a number of seats 82. For example, one seat member 50 of removable seats system 46 shown in FIG. 1 may include a single seat, an entire row of seats or a fraction of a row of seats including several seats. It is shown in FIG. 1 that the rows of seats are arcuate; removable seats system 46 is designed to accommodate not only arcuate rows of seats, but also straight linear rows of seats (not shown) or segmented rows of seats (not shown) comprising two or more straight or arcuate segments that are not parallel. Thus, although platforms 48 are shown in FIG. 1 to extend for substantially the entire width of main room portion 44 such that one platform 48 forms one aisle in main room portion 44, they could alternately extend for a fraction of the width of main room portion 44, for example two, three or more coextensive platforms could be installed to form each aisle in main room portion 44.

FIGS. 3-6 show a first and a second platform 48, 48' that are part of removable seats system 46. Herein, primed numbers on the second platform 48' refer to like structures on the first platform 48 and will not be described distinctly as they are similar. First and second platforms 48, 48' can thus have a same configuration.

Removable seats system 46 comprises vertical platform displacement means in the form of platform actuators 52, 52' that rest on and are fixed to the ground (not shown) at their bottom end. Platform actuators 52, 52' may comprise any suitable actuating mechanism allowing selective vertical displacement of platforms 48, 48'. In one embodiment, each platform actuator 52, 52' is in the form of a telescopic intertwined bands column such as the one described in U.S. Pat. No. 7,213,796 granted in 2007 to Gestion Laforest Inc. Removable seats system 46 may further include guide means (not shown) to help guide platforms 48 in their vertical movement. These guide means may for example be in the form of rails installed along the walls of room 40.

Each vertically movable platform 48 defines opposite upper and lower sides 48*a*, 48*b* and comprises a flat wall 54 fixedly carried on lower side 48*b* by a platform support structure that includes a hollow cross-sectionally rectangular longitudinal beam 56, longitudinal edgewise reinforcement tubular rods 58 and crossbars 59 (FIG. 5) that extend transversely between reinforcement rods 58. Platform actuator 52 engages and is fixedly attached to beam 56 at its top end. Consequently, platform 48 is capable of selective vertical displacement as controlled by platform actuator 52.

Flat wall 54 is usable as a partial floor surface on upper side 48*a*. When several platforms 48 are disposed side-by-side, the upper sides 48*a* of flat walls 54 collectively form the usable floor of room 40.

Each platform 48, for example second platform 48' as shown in FIGS. 3-6, comprises a seat stowing structure, generally identified with numeral 60'. Seat stowing structure 60' is more particularly attached to the lower side 48*b*' of second platform 48' wherein seat member 50 may be stowed on stowing structure 60' in a stowed position when it is not in its operative position.

Although first platform 48 in FIGS. 3-6 is not illustrated as equipped with a seat stowing structure for clarity purposes, it is understood that most if not all platforms, including first platform 48, could be equipped with a seat stowing structure.

Seat stowing structure 60' comprises a pair of rail members 62', 64'. Each rail member, for example rail member 62', comprises a pair of spaced-apart, parallel L-shaped rail plates 66', 68' fixedly attached to the underside of beam 56' that carry three rollers 70', 72', 74' (FIG. 5) therebetween. A flat rod-like carriage 76' is carried by and between rollers 70', 72', 74' so as to be movable along a horizontal direction. A carriage actuator 78' is capable of moving carriage 76' along said horizontal direction. Carriage actuator 78' can be a screw jack as shown in the drawings, or alternately any other suitable actuator such as a hydraulic cylinder or the like.

A seat member 50, stowed underneath second platform 48', is destined to be selectively installed on first platform 48 as detailed hereinafter. Although first platform 48 in FIGS. 3-6 is not illustrated as equipped with a stowed seat member for clarity purposes, it is understood that most if not all platforms, including first platform 48, could be equipped with a stowed seat member on its seat stowing structure.

Seat member 50 comprises a seat support structure in the form of a beam 80 that carries a number of seats 82. Seat member 50 also has a pair of support feet 84, 86 fixedly attached to the underside of beam 80 and extending perpendicularly away from beam 80.

Figure 3:
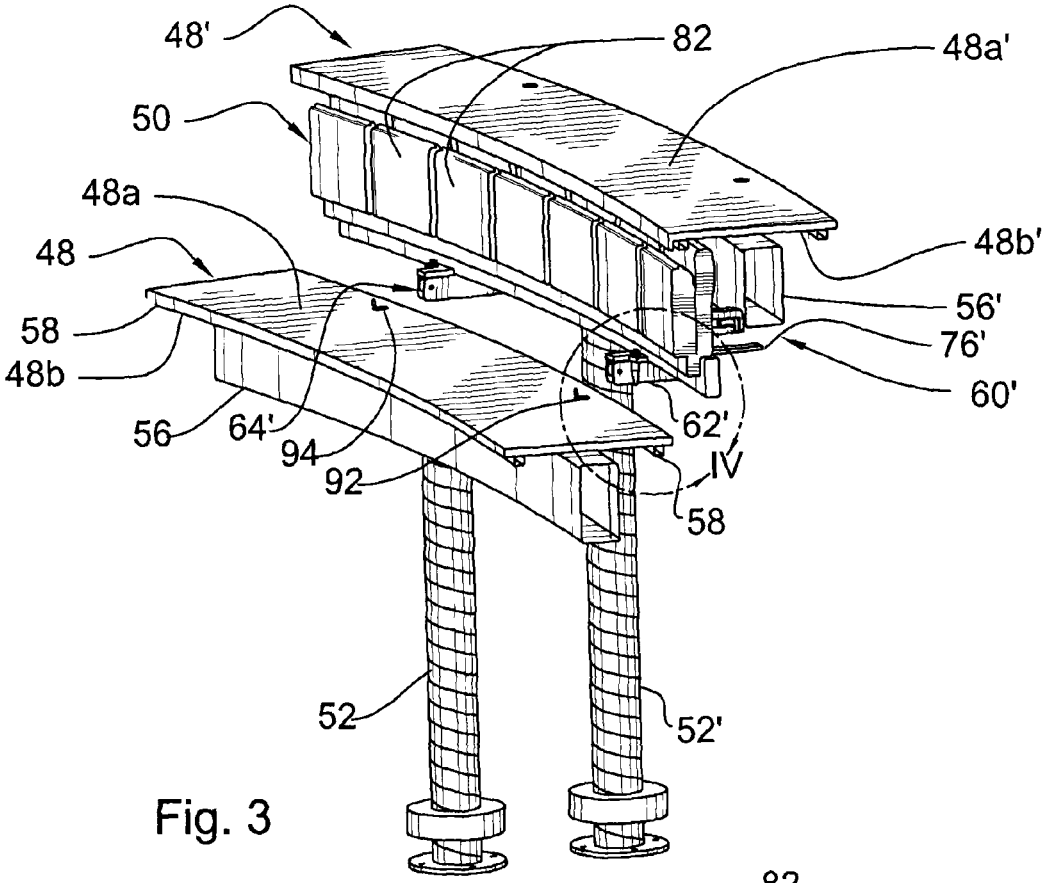
FIG. 3 is a perspective view of a pair of platforms and one seat member of the removable seats system of the present invention with the seat member in its stowed position.
Figure 4:
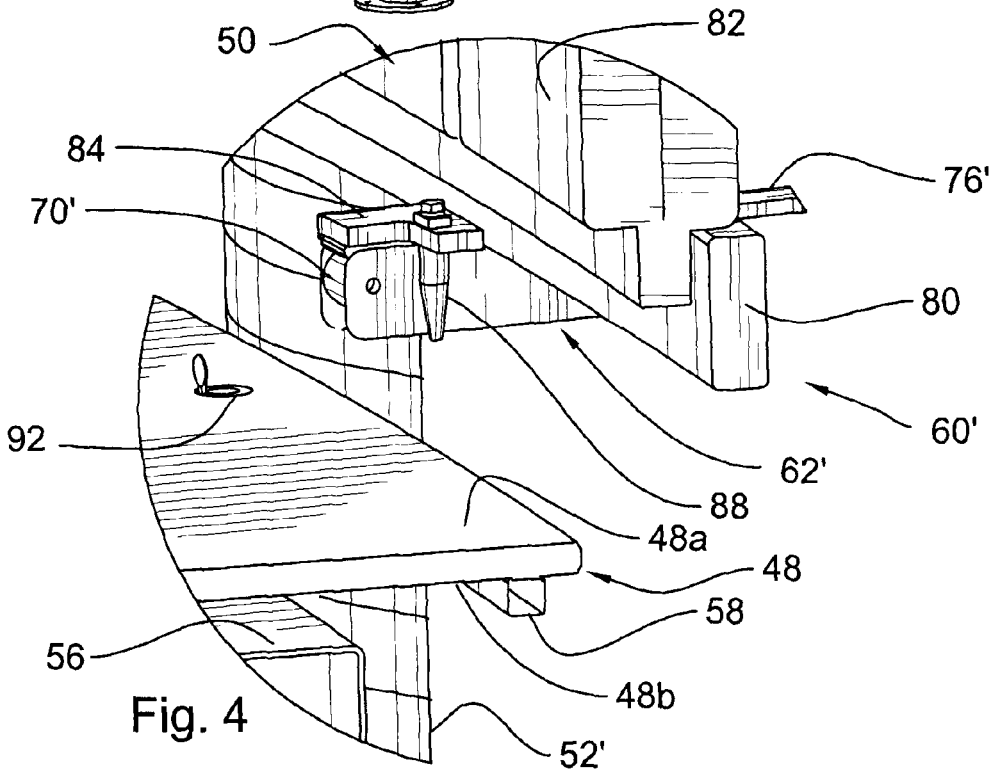
FIG. 4 is an enlarged perspective view of the area circumscribed by line IV in FIG. 3.
Figure 3A:
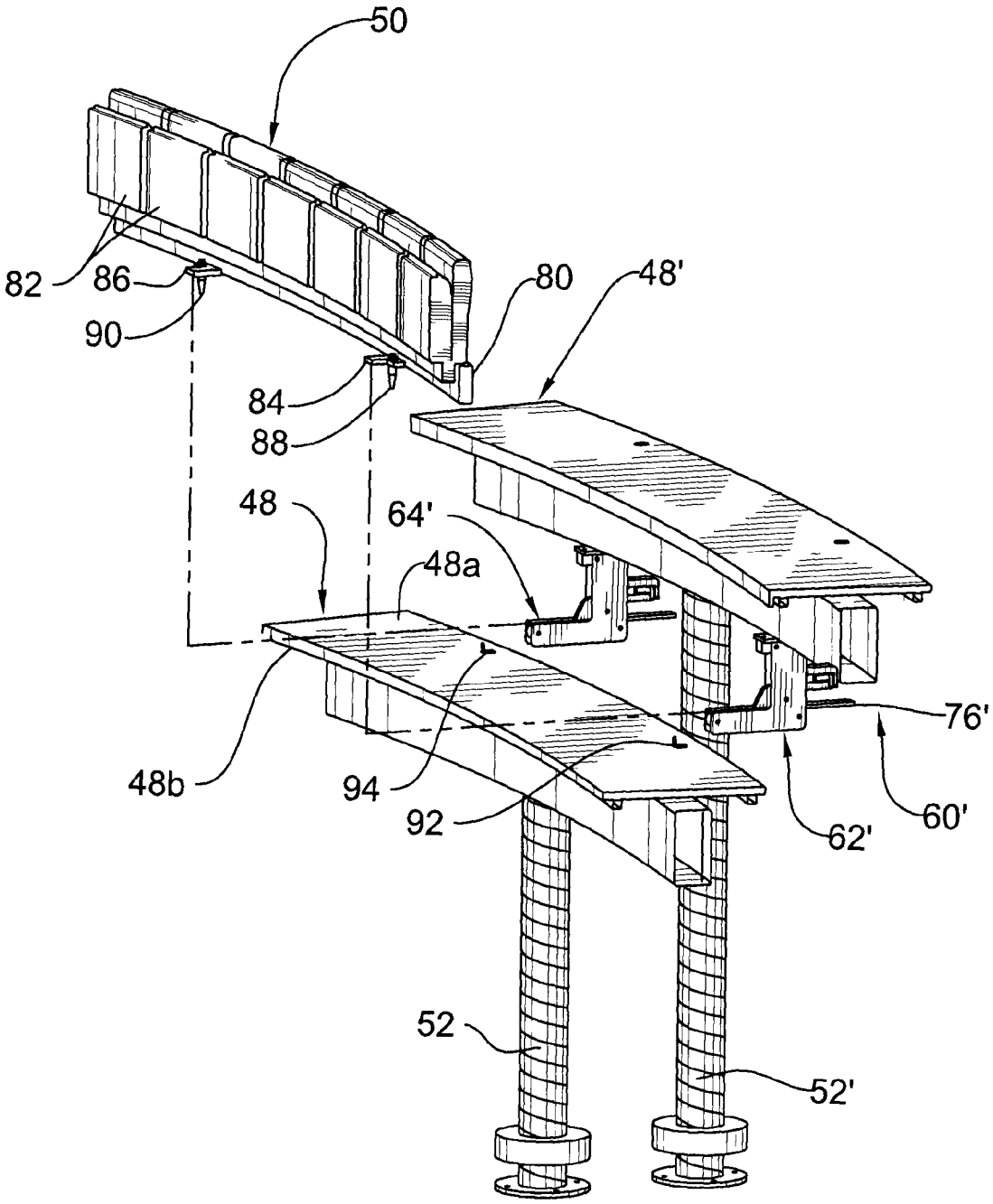
FIG. 3A is similar to FIG. 3, but shows the seat member removed from its stowed position.
Figure 5:
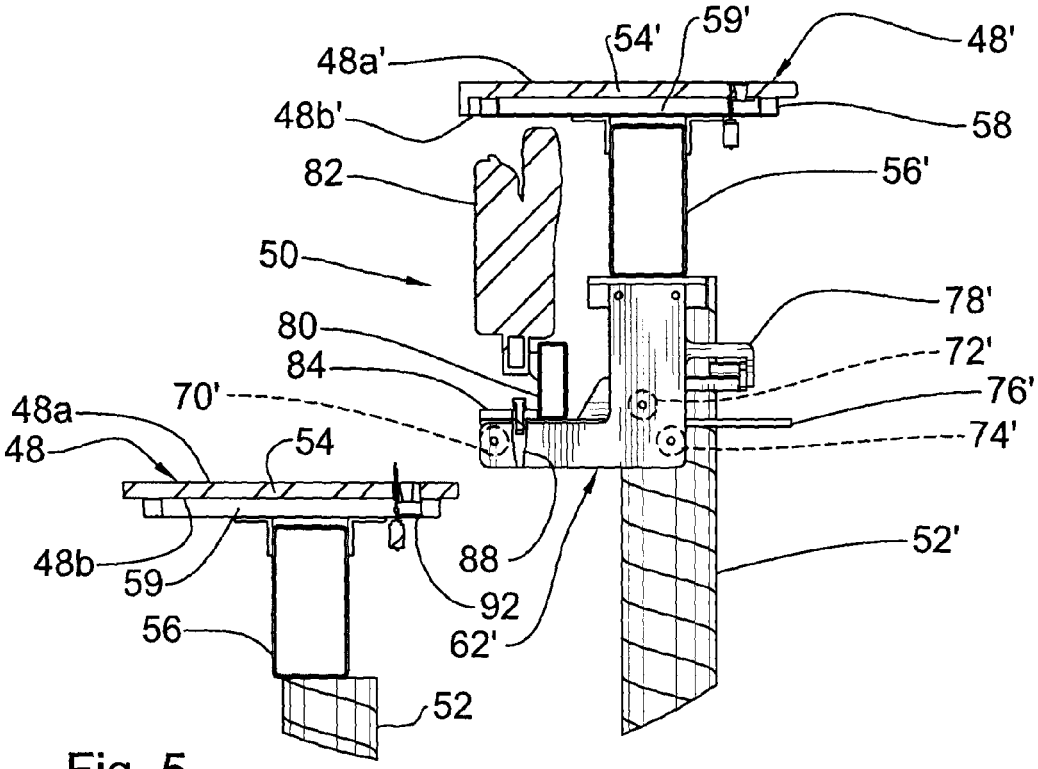
FIG. 5 is a cross-sectional side elevation, at an enlarged scale, of the removable seats system of FIG. 3 with the bottom portion of the platform actuators being removed.
Figure 6:
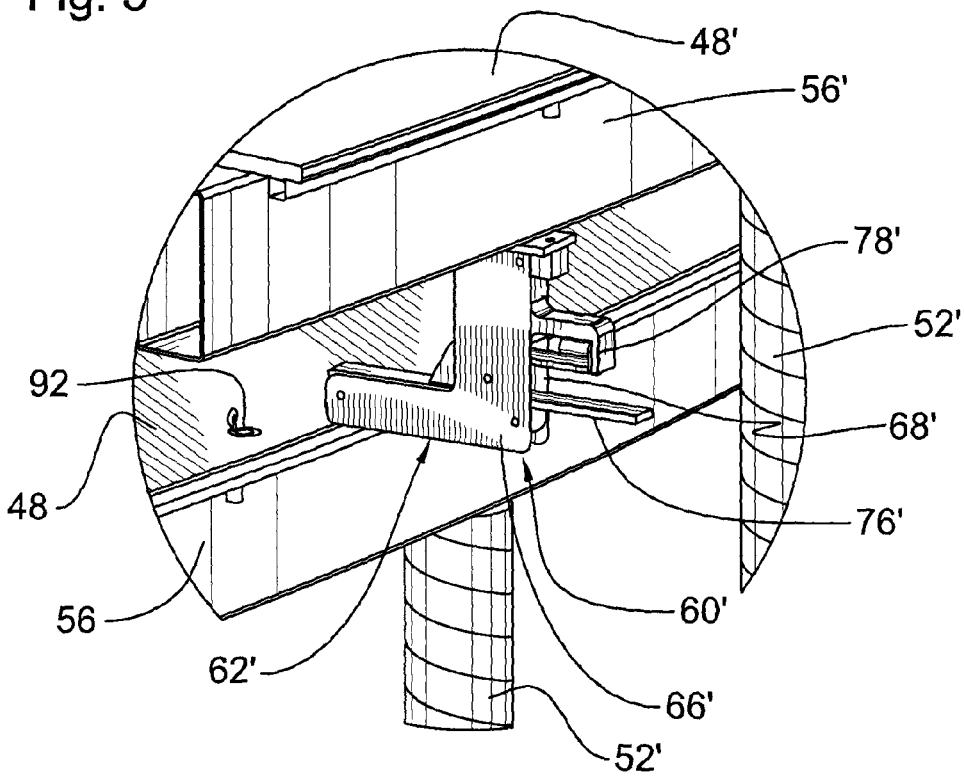
FIG. 6 is an enlarged perspective view of a seat displacer of the removable seats system of FIG. 3, also showing the adjacent portions of the platforms.

Seat member 50 may consequently rest on seat stowing structure 60' in its stowed position. More particularly, the seat member's support feet 84 and 86 may rest on the carriages 76' of rail members 62' and 64', respectively, as shown in FIGS. 3 and 5. Furthermore, upon activation of carriage actuators 78', carriages 76' may be moved along said horizontal direction thereby carrying seat member 50 in a horizontal displacement along said horizontal direction as further detailed hereinafter. Rail member 62', carriage 76' and carriage actuator 78' are herein considered to collectively form a horizontal seat displacer.

According to one alternate embodiment of the invention (not shown), the seat member could be pivoted from its stowed position either directly into its operative position or first in a position above the first platform, to then move the platform relative to the seat member until the seat member is in its operative position. This pivotal displacement would be accomplished by providing suitable pivotal seat displacement means such as a pivotable carriage that is pivotally carried by the second platform, instead of the linearly displaceable carriage 76' shown in the annexed drawings. It is understood that the horizontal seat displacer referred to in the present specification includes such alternate seat displacement means such as a pivotal displacer that includes a horizontal displacement component, and not just those seat displacers that include exclusively a horizontal component.

Removable seats system 46 further comprises first and second complementary male-female wedge members respectively provided on platforms 48, 48' and on seat members 50. More particularly, seat members 50 comprise male wedge members in the form of pin members 88, 90 that are fixedly attached to and downwardly depend from support feet 84, 86. Each pin member, for example pin member 88 shown in FIG. 9, comprises a generally cylindrical outer wall that tapers towards its lower extremity.

Platform 48 in turn comprises female wedge members in the form of sockets 92, 94 fitted in holes of corresponding shape made in platform 48. Each socket, for example socket 92 shown in FIGS. 7-9, comprises a sleeve or main body 96 fitted in the platform hole and an inner bore 98 in main body 96, with the inner bore 98 tapering towards its lower extremity.

Figure 9:
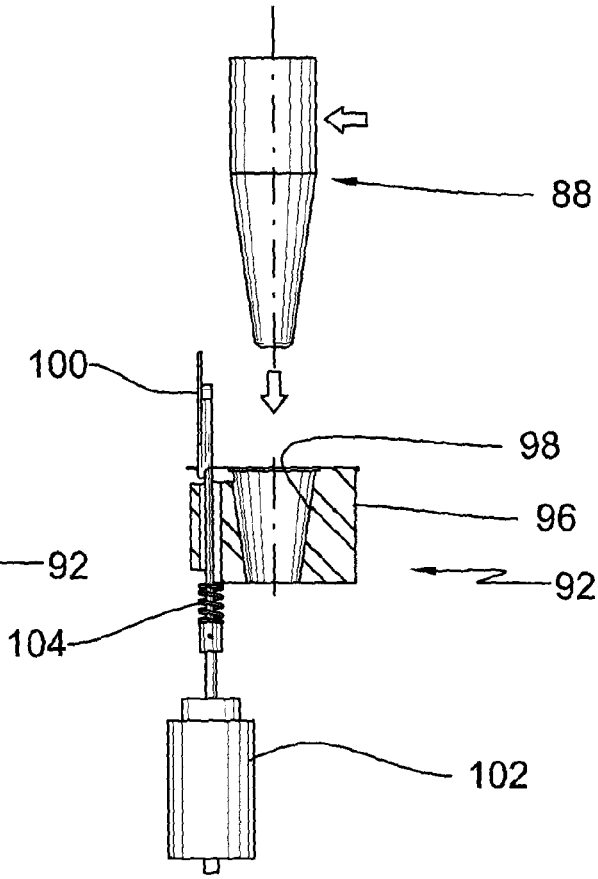

The size and configuration of pin member 88 and socket 92 are such that the releasable engagement or insertion of pin member 88 within socket 92 along their axes, as suggested in FIG. 9, will result in a releasable wedging relationship between the two as the tapering wall of pin member 88 slides along and engages the complementary tapering wall of socket bore 98. To obtain an optimal wedging relationship, the taper angle on pin member 88, 90 is preferably similar, if not identical, to the taper angle of bore 98.

It is understood that the relative position of the pin members and sockets could be inverted, namely the pin members could be provided on the platforms and the sockets on the seat members, with only marginal design modifications (including, presumably, arranging the pin members so that they would not protrude from the platform upper side 48*a*). Considering that the pin members and sockets are thus theoretically interchangeable, each pin member with its corresponding socket are herein said to form a pair of complementary male-female wedge members.

It is further understood that sockets 92, 94 could be formed integrally in platform 48. That is to say, sockets 92, 94 are shown in the drawings to have a cylindrical main body 96 fitted in a hole in platform 48; while alternately, the socket bore could be made directly in platform 48. One advantage of having a distinct socket body however, is that the hardness of the socket main body 96 is desirably more important than that of platform 48 itself to resist the load of pin member 88 therein (as seen hereinafter, the combined load of seat member 50 and attendees is transferred through pin member 88 to socket 92), without having to provide the entire platform flat wall 54 with a material having a similar hardness. In any event, the expression socket as used herein generally refers to a female member having a receiving end for receiving a complementary male member such a pin members 88, 90.

Figure 8:
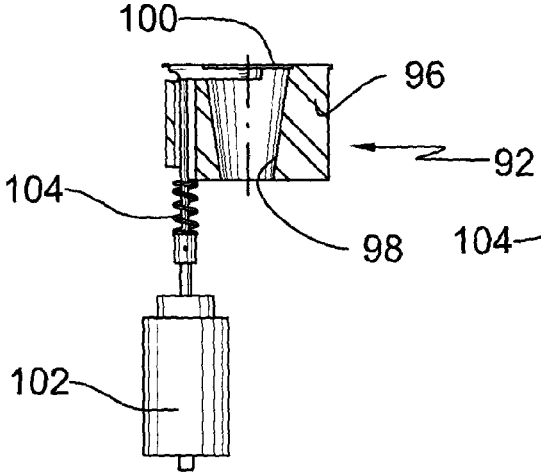
FIGS. 8 and 9 are cross-sectional side elevations of the socket of FIG. 7 sequentially showing the socket cap in closed and opened positions, with FIG. 9 further showing a seat member pin member overhanging the socket.
Figure 7:
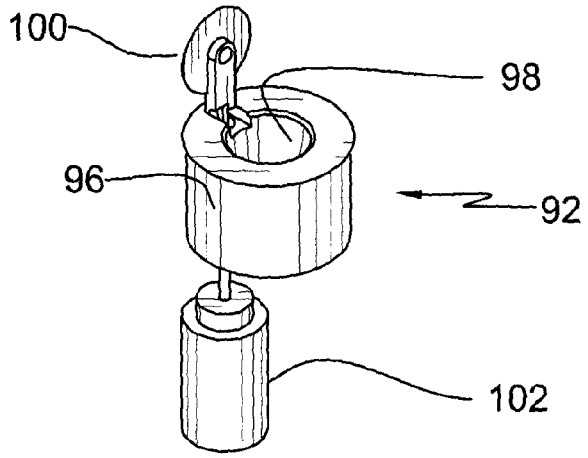
FIG. 7 is a perspective view of a socket of the removable seats system.

As shown in the drawings and in particular in FIGS. 7-9, socket 92 comprises a cap 100 pivotally connected to main body 96 and movable between an opened position (FIGS. 7 and 9) in which access to tapering bore 98 is allowed and a closed position (FIG. 8) in which bore 98 is covered. A cap actuator 102 is provided to selectively control the position of cap 100 and a biasing member in the form of a coil spring 104 is also provided to continuously force cap 100 towards its closed position.

Figure 10:
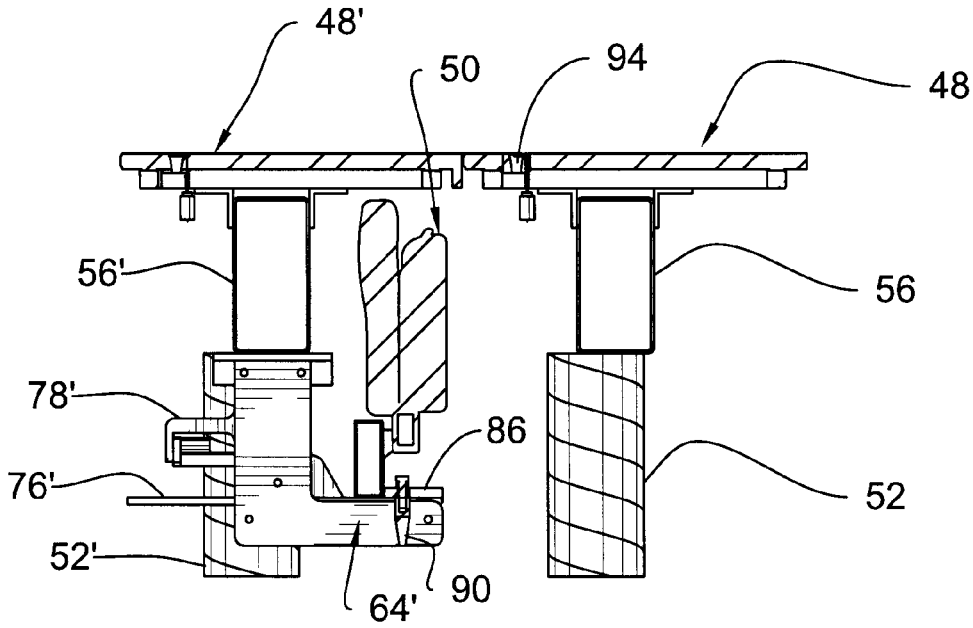
FIGS. 10-15 are cross-sectional side elevations of the removable seats system of FIG. 3, taken from the opposite side, with the bottom portion of the platform actuators being removed, sequentially showing how a seat member may be installed in its operative position on a first platform from its stowed position under a second platform.

In use, in the case where all seat members 50 in room 40 are in their stowed position as shown in FIGS. 3 and 10, all platforms 48 of room 40 may be positioned at a same vertical height to collectively form a uniformly flat floor surface where attendees in room 40 may stand or where other furniture such as tables and chairs may be installed. To change the configuration of room 40 from its free floor configuration to its theatre room configuration wherein seat members 50 are provided in their operative position for the attendees, removable seats system 46 allows a transformation in room 40 during which platforms 48 and seat members 50 are moved as follows.

FIGS. 10-15 sequentially show how a seat member 50 may be moved from its stowed and concealed position underneath second platform 48' to its operative position whereby seat member 50 will rest atop first platform 48.

Initially, seat member 50 is carried by rail members 62', 64' underneath second platform 48' in its stowed position as shown in FIG. 10. More particularly, the seat member support feet 84, 86 rest on the rail member carriages 76' (see also FIG. 4). As suggested in FIG. 10, each seat 82 may be folded upon itself to occupy less space. The caps 100 of sockets 92, 94 are in their closed position to cover bores 98.

With seat member 50 in its stowed position, platform top surface 48*a* is free and platform 48 participates in the so-called free floor configuration of room 40. All platforms 48 in room 40 can be positioned adjacent one another to form a continuous, free and flat floor surface as mentioned above. As shown in FIG. 10, the gap or play between first and second adjacent platforms 48, 48' is small or inexistent: in other words, adjacent first and second platforms 48, 48' may abut one another along their longitudinal edges or may include platform stabilizing means (not shown) that bridge across first and second platforms 48, 48' to prevent relative movement thereof. This provides a stable engagement of platforms 48, 48' against each other, helping to prevent or reduce perceptible movements and vibrations.

Figure 11:
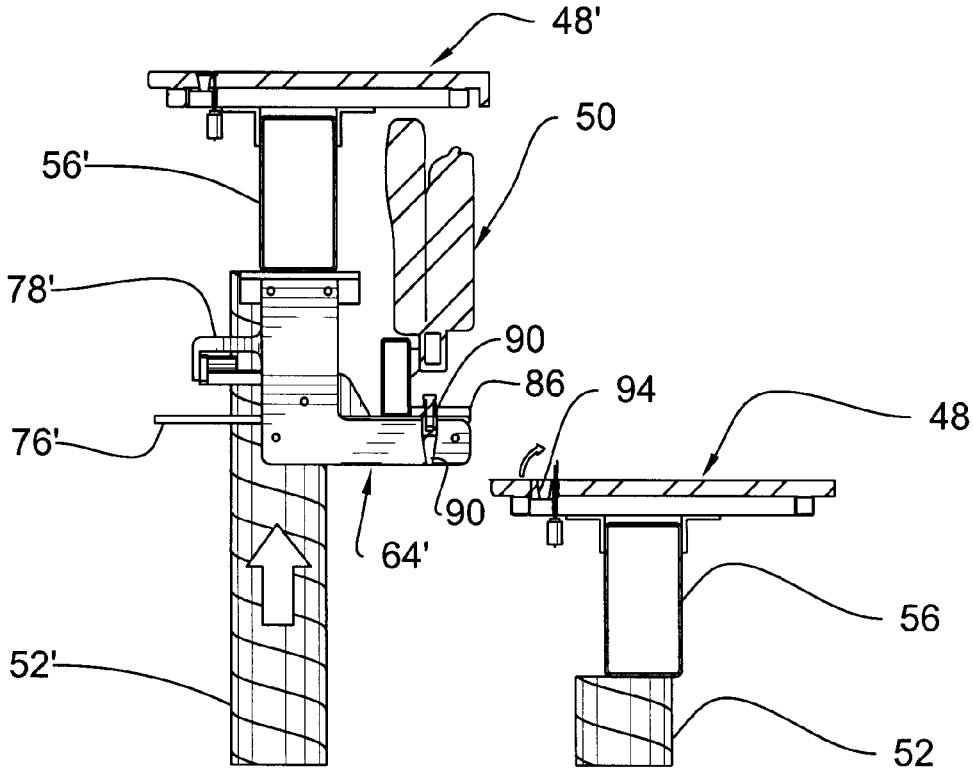

To move seat member 50 from its stowed position to its operative position, second platform 48' is first raised relative to first platform 48 as shown in FIG. 11. This vertical displacement is accomplished by means of platform actuator 52' raising second platform 48' to a selected vertical position in which seat member 50 vertically clears first platform 48, or by lowering first platform 48, or both raising second platform 48' and lowering first platform 48.

Socket caps 100 are opened to allow access into sockets 92, 94.

Figure 12:
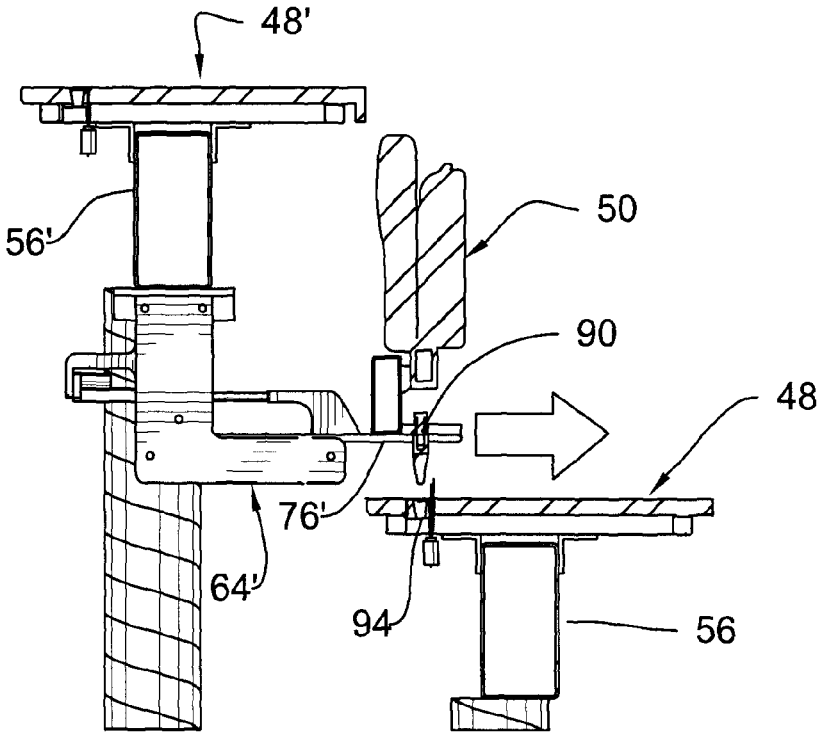

Then, as shown in FIG. 12, the carriage actuators 78' move carriages 76' horizontally over first platform 48, concurrently carrying seat member 50 over first platform 48. More particularly, seat member 50 will be moved over first platform 48 until pin members 88, 90 become vertically aligned with corresponding sockets 92, 94.

Figure 13:
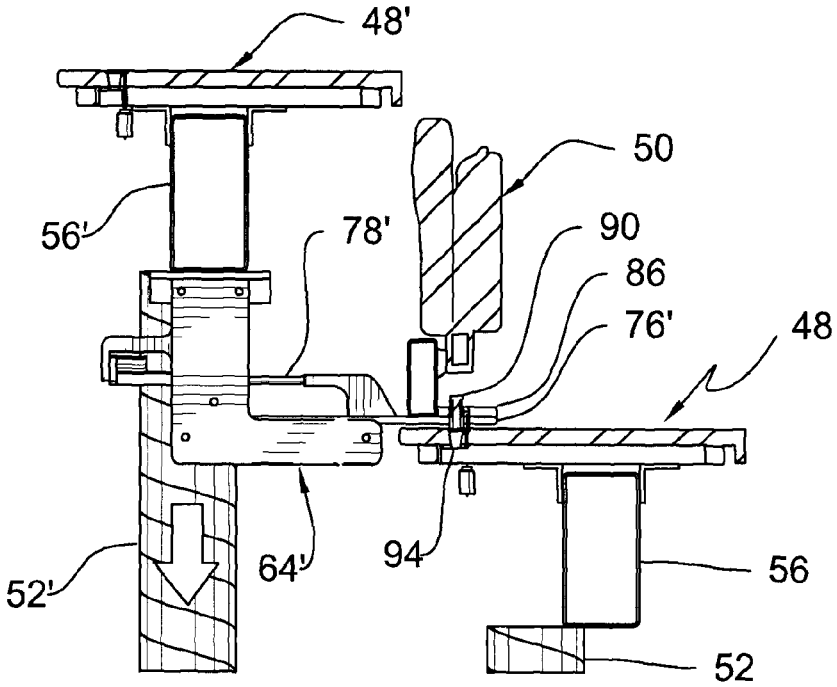

FIG. 13 shows that platform actuator 52' then lowers second platform 48' until seat member 50 comes to rest on second platform 48. The load of seat member 50 is consequently transferred from carriages 76' to second platform 48, still through support feet 84, 86 albeit through the instrumentality of pin members 88, 90 engaging sockets 92, 94. More particularly, pin members 88, 90 of seat member 50 will be inserted and wedged into their corresponding sockets 92, 94 of first platform 48 due to the complementary tapered shapes of pin members 88, 90 and sockets 92, 94. These complementary tapered shapes of pin members 88, 90 and sockets 92, 94 allow a stable, releasable, wedged inter-engagement of pin members 88, 90 and sockets 92, 94 which in turn allows seat member 50 to stably rest on platform 48. Seat member 50 does not contact first platform 48 at any other point than between pin members 88, 90 and sockets 92, 94 when it is in its operative position.

Even very small relative movements between seat member 50 and first platform 48 would be perceptible by a person sitting in seat member 50. Consequently, the complementary tapered shape of pins 88, 90 and sockets 92, 94 are very advantageous in preventing a loose engagement while still allowing pins 88, 90 from easily engaging and then releasing and disengaging sockets 92, 94 when seat member 50 is being removed (as detailed hereinafter). Furthermore, the complementary tapered shape of pin members 88, 90 and sockets 92, 94 further allows for an auto-alignment of seat member 50 during installation. Indeed, small positional deviations may exist between the axes of pint members 88, 90 and that of the bores 98 of sockets 92, 94 when they are being aligned before seat member is lowered for the wedged engagement of pins 88, 90 into sockets 92, 94. The complementary tapered shapes of pin members 88, 90 and sockets 92, 94 allows to correct small misalignments by the sloping peripheral wall of pin members 88, 90 sliding against and into the sloping peripheral wall of sockets 92, 94.

The installation of seat member 50 according to the present invention is further advantageous in that seat member 50 is not moved along the platform top surface, either in sliding or rolling engagement as in some prior art systems, avoiding the platform top surface 48*a* from being damaged. Not only that, but the seat member tapered pin members 88, 90 being lowered into sockets 92, 94 allows for very punctual contact points between the seat member and the platform. By providing pin members 88, 90 and sockets 92, 94 with an inherent hardness which is much greater than that of the platform 48 top surface, production costs are limited to a minimum while the hardness at these contact points will remain sufficiently high.

As a consequence, the actual visible top surface 48*a* of platform 48 is never contacted, either dynamically or statically, by seat member 50, which prevents it from being damaged by seat member 50 aesthetically or structurally. This significantly limits the wear of platform top surface 48*a*.

As mentioned hereinabove, seat member 50 could alternately be moved from its stowed position to its operative position through a displacement that is not exclusively linearly horizontal, such as a pivotal displacement (not shown) of seat member 50. This pivotal displacement could first position pin members 88, 90 spacedly above sockets 92, 94 similarly to what carriages 76' accomplish; or they could even pivot seat member 50 from its stowed position directly into its operative position. Generally, any displacement that includes at least a horizontal component is considered to be included within the scope of the present invention's horizontal displacement. Even in such alternate displacements of seat member 50, seat member 50 remains positioned spacedly over platform 48 during this displacement to maintain a single contact point between seat member 50 and platform 48 at pin members 88, 90 and sockets 92, 94.

Figure 14:
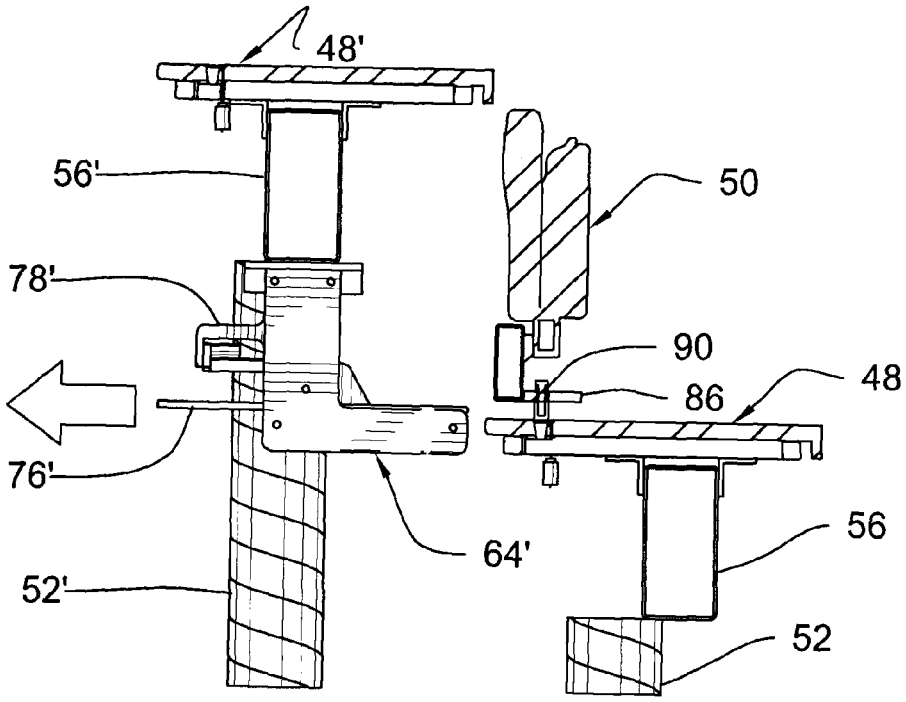

As shown in FIG. 14, once seat member 50 rests on first platform 48, carriages 76', now relieved of the load of seat member 50, may be retrieved by activating carriage actuators 78' to move carriages 76' rearwardly underneath second platform 48'.

Figure 15:
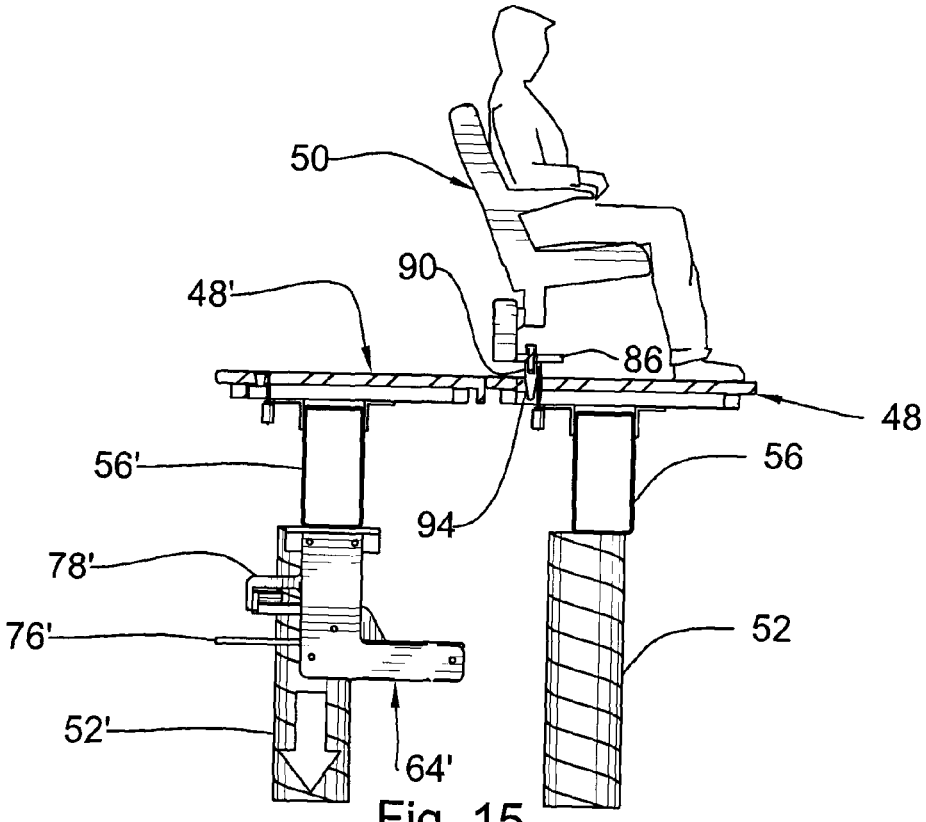

Next, as shown in FIG. 15, platform actuator 52' is activated to lower second platform 48' at a desired height, for example coplanar to first platform 48. An attendee may now sit on seat member 50. The wedged relationship between tapered pins 88, 90 and the complementary tapered sockets 92, 94 prevents any horizontal or pivotal movement of seat member 50 relative to first platform 48. Indeed, the load of seat member 50 and of any attendees seated thereon contribute to stabilize seat member 50 by applying a downward force in the direction of the axes of pin members 88, 90 and sockets 92, 94, thereby stably maintaining the wedged engagement of pins 88, 90 into sockets 92, 94.

The above explanations with reference to FIGS. 10-15 have shown how one seat member 50 may be installed on one platform 48. This procedure may be repeated to install numerous seat members in room 40, for example one seat member on each platform, to form a number of aisles each comprising one or more coextensive platforms one which one or more seat members are installed. So in the example of FIGS. 10-15, a third platform (not shown) could be located rearwardly adjacent to second platform 48' and be provided with a second seat member in a stowed position underneath this third platform. Following the above-described steps to install a seat member, this second seat member would be moved from its stowed position to an operative position on second platform 48'. Likewise, a third seat member (not shown) could be provided in a stowed position underneath first platform 48, to install this third seat member in an operative position on a fourth platform (not shown) that would be located frontwardly adjacent to first platform 48. Thus, each platform 48 in room 40 may have a stowed seat member 50 underneath it to install the seat member atop a frontwardly adjacent platform 48. The rows of platforms 48 will simply be sequentially vertically moved to allow each seat member 50 to be sequentially installed on its frontwardly adjacent platform 48. In the end, platforms 48 may be positioned at a desired elevation for the rows of seats to be either coplanar or sloping, for example they may gradually rise towards the back of room 40 if a gradually rising seat configuration is desired as is usual in theatre rooms and as suggested in FIG. 2.

To remove a seat member 50 from its operative position on first platform 48, the above-mentioned steps are accomplished in the opposite order: second platform 48' is raised; the carriages 76' are moved forwardly until they extend underneath the seat member support feet 84, 86; second platform 48' is raised again with carriages 76' engaging seat member support feat 84, 86 to allow seat member 50 to be vertically lifted spacedly over first platform 48 until pin members 88, 90 disengage and vertically clear sockets 92, 94; and carriages 76' are then moved rearwardly, carrying seat member 50 underneath second platform 48' to its stowed position. Second platform 48' may be moved to a desired vertical height, for example so as to be coplanar with first platform 48. Socket caps 100 are finally closed to conceal the socket inner bores 98.

Figure 17:
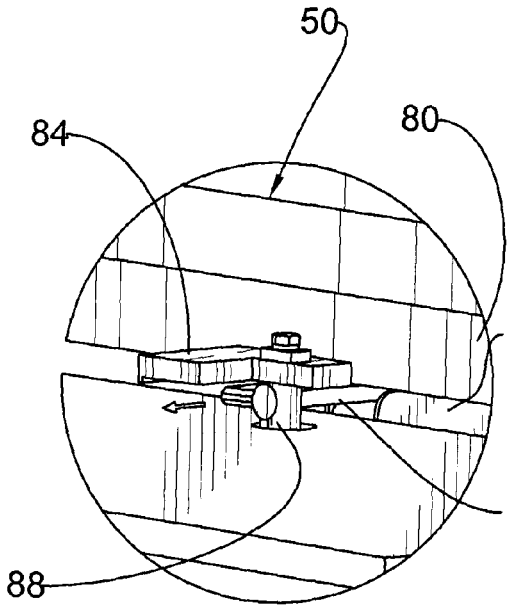
FIGS. 17-20 are perspective views, at an enlarged scale, of a seat member pin member engaging a platform socket that sequentially show how the seat member carriage may retrieve the seat member to disengage the pin member from the socket when the seat member is moved away from its operative position towards its stowed position.
Figure 18:
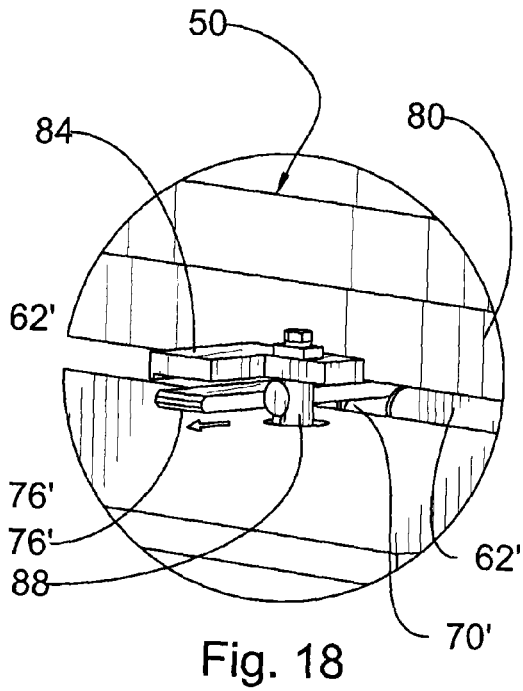
Figure 19:
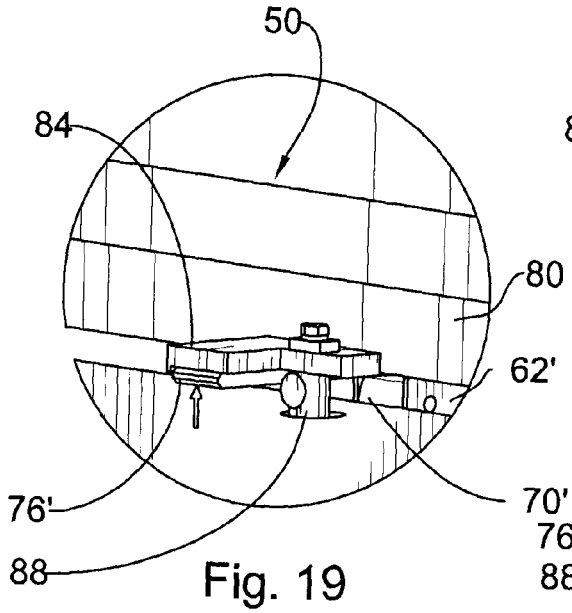
Figure 20:
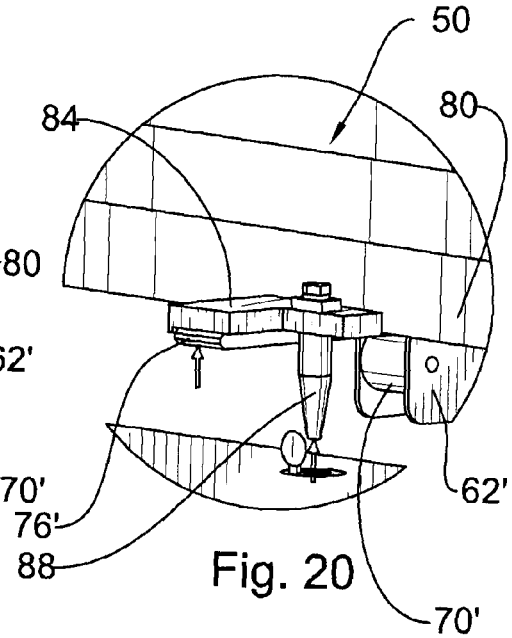

FIGS. 17-20 focus on the engagement of one carriage 76' with its corresponding support foot 84 during the steps of moving seat member 50 from its operative to its stowed position. In FIGS. 17 and 18, the forward movement of carriage 76' underneath support foot 84 is sequentially suggested. FIGS. 19 and 20 in turn sequentially show the vertical displacement of carriage 76' as it is lifted concurrently with second platform 48' to engage foot member 84 and lift seat member 50.

It is noted again that vertical movement of second platform 48' is made relatively to first platform 48 and that consequently this vertical movement could be accomplished by moving either one of second platform 48' or first platform 48 or both, as long as the desired relative movement between the two is obtained. This is true even though in the present description it may occasionally be mentioned that one or the other platform is being moved independently from the other.

Figure 16:
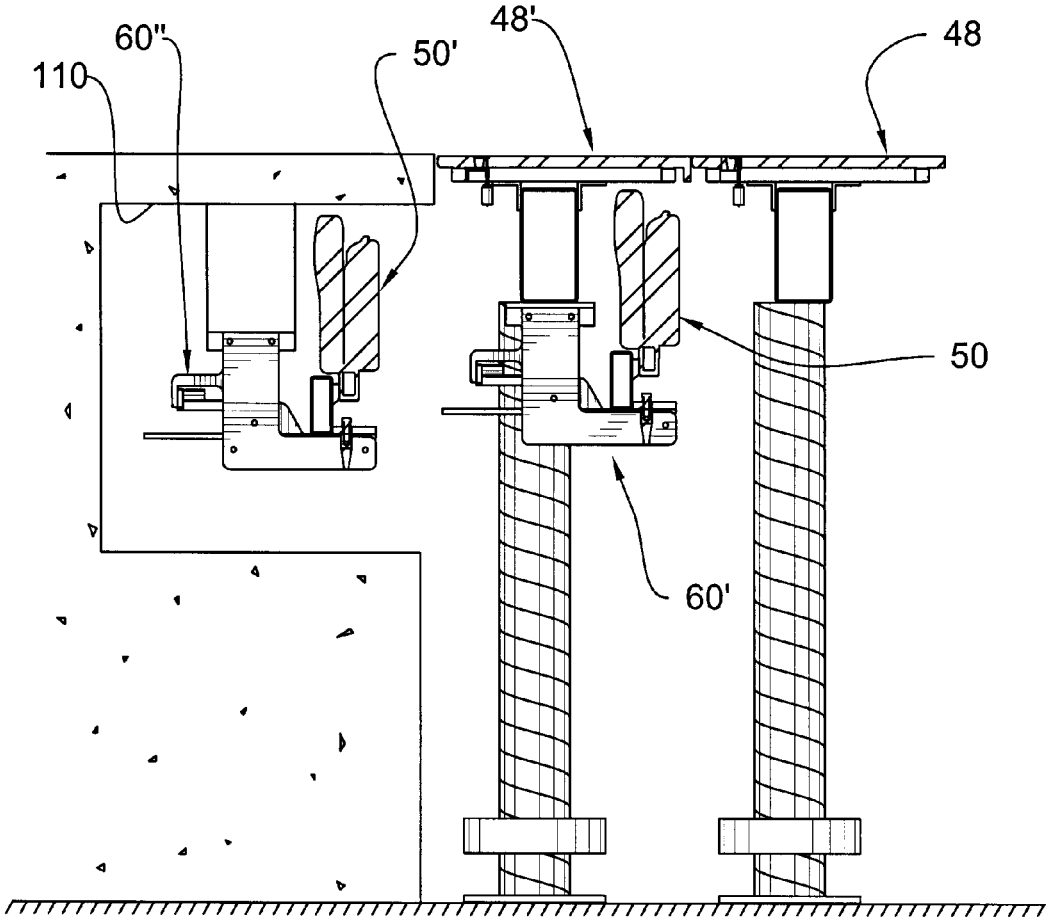
FIG. 16 is a view similar to FIG. 10, but showing how a seat member to be installed on a rearmost platform may be stowed in a niche in a fixed structure.

FIG. 16 shows that a second seat member 50' can be concealed in a stored position in a niche 110 formed in the fixed structure of room 40, for installation on the second platform 48' when the latter is in the rearmost row of platforms in room 40. A horizontal seat displacer 60" similar to seat displacer 60' is installed in niche 110. Second platform 48' is vertically lowered for seat member 50' to be installed thereon.

It is noted that each seat member could be stowed under the rearwardly adjacent (second) platform with respect to the platform on which it is to be installed, under the same (first) platform on which it is to be installed or under the frontwardly adjacent platform with respect to the platform on which it is to be installed. In the case where it is stowed under the frontwardly adjacent or rearwardly adjacent platform with respect to the platform on which it is to be installed, horizontal seat displacers such as the ones disclosed hereinabove may be used to horizontally move the seat away from and towards its stowed position. If the seat member is stowed under the same platform on which it is to be installed, a different type of seat displacer (not shown) should then be used, for example a seat displacer that pivots the seat member away from and towards its stowed position to bring it towards its operative position.

FIG. 2 shows that platforms 48 may be provided with optional skirts 120 which prevent access underneath platforms 48 when platforms 48 are vertically offset.

Generally, removable seats system 46 of the present invention could be fully automated or at least partly manual. For example, seat members 50 could be moved horizontally along seat rails 36 either through the instrumentality of automated carriage actuators 78' as described hereinabove or alternately by manually pulling or pushing on seat member 50 to force carriages 76' to roll along rail members 62', 64'. Likewise, the socket caps 100 could be opened and closed either automatically through electronic controls or manually. The manual approach is of course less expensive.

In one alternate embodiment of the invention (not shown), the seat member pin members are cylindrical and engage complementary cylindrical socket bores. The pin members then preferably have very little play between them and their corresponding sockets to avoid or minimize movement of the seat relative to the platform.

One way to avoid or minimize movement between the pin members and the sockets is to include a locking mechanism for releasably locking the pins within their socket bores, in the operative position of the seat member. The wedging relationship of the tapering pin members in the complementary tapering bores is considered one embodiment of a locking mechanism in itself since it helps avoid accidental release of the pin members from the sockets. Indeed, once wedged into place, the pin members are likely to require a significant upward force to disengage their corresponding sockets, especially if the seat members are heavy. Other locking mechanisms (not shown) are also envisioned such as a transverse locking rod that would releasably engage both the socket and the pin member when the pin member engages the socket. Such other locking mechanisms could be used if the pin members and socket bores are of cylindrical shape or tapering.

In the alternate embodiment where the pin members are cylindrical, they might be provided with a tapering tip to self-align with the bores when the seat members are lowered in the socket bores, even if the pin member peripheral wall portion that engages the socket bore is cylindrical.

Generally, it is understood that any suitable pair of complementary male-female engagement members would be acceptable (although the embodiment including wedge members as engagement members as described hereinabove is particularly advantageous). Indeed, one particular advantage of the present invention is to provide male-female inter-engagement between the seat member and the platform at designated areas, namely at a first male-female engagement member on the platform and at a second male-female engagement member on the seat member. This allows to control where the load of the seat member will be supported by the platform (namely, through the first and second male-female engagement member) to reinforce that particular area, for example by providing a socket and a pin member with suitable mechanical properties. It also allows to avoid compromising the structure of the platform to accommodate the seat members and damaging the platform by engaging the seat member on important regions thereon. The essentially punctual engagement and support of the seat member on the platform at each pin member-socket assembly is how this advantage is achieved. It is understood however that other elements than pin members as second engagement members could be used to obtain that advantage, including support plates or the like.

I claim:

1. A removable seats system comprising:

a first vertically movable platform defining opposite upper and lower sides;

a seat member comprising at least one seat; and first and second complementary male-female engagement members respectively provided on said first platform and on said seat member; wherein said seat member is removably supported in an operative position on said upper side of said first platform through a releasable engagement of said first and second male-female engagement members with one another, and wherein a load of said seat member substantially perpendicular to said upper side of said first platform is transmitted by said second male-female engagement member to said first male-female engagement member.

2. A removable seats system as defined in claim 1, wherein said seat member comprises a number of pin members having a tapering outer wall and said platform comprises a number of sockets having a tapering bore, each said socket capable of receiving one of said pin members in releasable wedging relationship.

3. A removable seats system as defined in claim 2, wherein each said socket comprises a cap movable between an opened position in which access to said tapering bore is allowed and a closed position in which said socket cap covers said tapering bore, whereby one of said pin members is received in a corresponding said socket when said socket cap is in said opened position.

4. A removable seats system as defined in claim 1, further comprising a second platform defining upper and lower sides and which is horizontally adjacent and vertically movable with respect to said first platform, and a seat stowing structure installed on said lower side of said second platform wherein said seat member is stowed on said stowing structure in a stowed position when said seat member is not in said operative position.

5. A removable seats system as defined in claim 4, further comprising a first horizontal seat displacer provided on said second platform and capable of moving said seat member along a horizontal direction, wherein through the combined vertical relative movement of said first and second platforms and horizontal movement of said first horizontal seat displacer, said seat member is moved between said stowed position and said operative position.

6. A removable seats system as defined in claim 5, wherein said first horizontal seat displacer comprises a first rail member on which a first carriage is movable and a first carriage actuator capable of moving said first carriage along said horizontal direction, whereby said seat member resting on said carriage is moved along said horizontal direction.

7. A removable seats system as defined in claim 6, further comprising a second horizontal seat displacer comprising a second rail member on which a second carriage is movable and a second carriage actuator capable of moving said second carriage along said horizontal direction, whereby said seat member resting on said first and second carriage is moved along said horizontal direction.

8. A removable seats system as defined in claim 1, further comprising a releasable locking mechanism for releasably locking said first and second male-female engagement members with one another.

9. A removable seats system as defined in claim 1, wherein the load of said seat member is entirely transmitted by said second male-female engagement member to said first male-female engagement member.

10. A removable seats system comprising:

a first vertically movable platform defining opposite upper and lower sides;

a seat member comprising at least one seat; and first and second complementary male-female engagement members respectively provided on said first platform and on said seat member; wherein said seat member is removably supported in an operative position on said upper side of said first platform through a releasable engagement of said first and second male-female engagement members with one another, and wherein a load of said seat member is transmitted by said second male-female engagement member to said first male-female engagement member, wherein said first and second male-female engagement members respectively comprise first and second complementary male-female wedge members, and wherein one of said first and second male-female wedge members has a tapering outer wall, the tapering outer wall defined by a first end of the one of said first and second male-female wedge members having a greater width than a second end of the one of said first and second male-female wedge members, whereby said seat member is removably installed in said operative position on said upper side of said first platform through the releasable engagement of said first and second male-female wedge members with one another in a wedging relationship.

11. A removable seats system as defined in claim 10, wherein one of said first and second male-female wedge members comprises a pin member and the other of said first and second male-female wedge members comprises a socket having a tapering bore for receiving said pin member in releasable wedging relationship.

12. A method of removably installing a seat member having at least one seat in an operative position on a first platform having upper and lower sides, comprising the steps of:

providing first and second complementary male-female engagement members respectively on said first platform and on said seat member;

moving said seat member spacedly over and relative to said first platform upper side until said first and second male-female engagement members releasably engage one another; and supporting said seat member on said platform through an engagement of said first and second male-female engagement members, wherein a load of said seat member substantially perpendicular to said upper side of said first platform is transmitted by said second male-female engagement member to said first male-female engagement member.

13. A method according to claim 12, wherein the step of moving said seat member spacedly over and relative to said first platform upper side until said first and second male-female engagement members releasably engage one another comprises the following steps:

positioning said seat member spacedly over said first platform upper side for said first and second male-female engagement members to become aligned with one another; and lowering said seat member relative to said first platform upper side until said first and second male-female engagement members releasably engage one another, said first platform thereby supporting said seat member through the inter-engagement of said first and second male-female engagement members.

14. A method according to claim 13, further comprising the following steps:

providing a second platform having upper and lower sides and which is horizontally adjacent and vertically movable with respect to said first platform, said second platform comprising a seat stowing structure installed on its lower side; and before the step of positioning said seat member spacedly over said first platform upper side for said second male-female engagement members to become aligned with said first male-female engagement members, providing said seat member on said stowing structures in a stowed position.

15. A method according to claim 14, further comprising the step of providing a horizontal seat displacer on said second platform capable of moving said seat member along a horizontal direction, wherein the step of positioning said seat member spacedly over said first platform upper side for said second male-female engagement members to become aligned with said first male-female engagement members is accomplished by relatively positioning said first and second platforms vertically to have said seat member vertically clear said first platform above said first platform upper side when it is in said stowed position and by thereafter moving said seat member along said horizontal direction by means of said horizontal seat displacer, and wherein the step of lowering said seat member relative to said first platform upper side until said first and second male-female engagement members releasably engage one another is accomplished by vertically moving said first and second platforms with respect to one another.

16. A method as defined in claim 15, wherein said horizontal seat 5 displacer comprises a rail member on which a carriage is movable and a carriage actuator capable of moving said carriage along said horizontal direction, with said seat member resting on said carriage when in said stowed position, the step of moving said seat member along said horizontal direction by means of said horizontal seat displacer comprising moving said carriage along said horizontal direction while said seat member rests on said carriage.

17. A method as defined in claim 15, wherein the step of providing first and second complementary male-female engagement members respectively on said first platform upper side and on said seat member comprises providing complementary first and second male-female wedge members respectively on said first platform and on said seat member whereby the step of lowering said seat member relative to said first platform upper side until said first and second male-female engagement members releasably engage one another is accomplished by vertically moving said first and second platforms with respect to one another until said first and second male-female wedge members releasably engage one another in wedging relationship.

18. A method as defined in claim 13, further comprising the following step during or after the step of lowering said seat member relative to said first platform upper side until said first and second male-female engagement members releasably engage one another:

releasably locking said first and second engagement members to one another.

19. A method according to claim 12, wherein in the step of supporting said seat member on said platform, the load of said seat member is entirely transmitted by said second male-female engagement member to said first male-female engagement member.

20. A method of removably installing a seat member having at least one seat in an operative position on a first platform having upper and lower sides, comprising the steps of:

providing first and second complementary male-female engagement members respectively on said first platform and on said seat member;

moving said seat member spacedly over and relative to said first platform upper side until said first and second male-female engagement members releasably engage one another; and supporting said seat member on said platform through an engagement of said first and second male-female engagement members, wherein a load of said seat member is transmitted by said second male-female engagement member to said first male-female engagement member, wherein the step of moving said seat member spacedly over and relative to said first platform upper side until said first and second male-female engagement members releasably engage one another comprises the following steps:

positioning said seat member spacedly over said first platform upper side for said first and second male-female engagement members to become aligned with one another; and lowering said seat member relative to said first platform upper side until said first and second male-female engagement members releasably engage one another, said first platform thereby supporting said seat member through the inter-engagement of said first and second male-female engagement members, and wherein the step of providing first and second complementary male-female engagement members respectively on said first platform upper side and on said seat member comprises providing complementary first and second male-female wedge members respectively on said first platform and on said seat member, with one of said first and second male-female wedge members having a tapering outer wall, the tapering outer wall defined by a first end of the one of said first and second male-female wedge members having a greater width than a second end of the one of said first and second male-female wedge members, and wherein in the step of lowering said seat member relative to said first platform upper side until said first and second male-female engagement members releasably engage one another, said first and second male-female wedge members releasably engage one another in wedging relationship.

21. A method according to claim 20, wherein the step of providing first and second male-female wedge members respectively on said first platform upper side and on said seat member comprises providing pin members on said seat members and sockets having a tapering bore on said platforms whereby in the step of lowering said seat member relative to said first platform upper side until said first and second male-female wedge members releasably engage one another, said pin members are received in said socket bores in releasable wedging relationship.

22. A method according to claim 21, further comprising the following steps:

providing caps covering said sockets tapering bores; and before the step of lowering said seat member relative to said first platform upper side until said first and second male-female wedge members releasably engage one another, moving said caps towards an opened position in which access to said tapering bores is allowed.

* * * * *